US008286263B2

(12) United States Patent
Sampson-Howlett

(10) Patent No.: US 8,286,263 B2
(45) Date of Patent: Oct. 16, 2012

(54) VERSATILE HOSPITAL GOWN

(76) Inventor: Susan Sampson-Howlett, Austin, TX (US)

( * ) Notice: Subject to any disclaimer, the term of this patent is extended or adjusted under 35 U.S.C. 154(b) by 197 days.

(21) Appl. No.: 12/814,960

(22) Filed: Jun. 14, 2010

(65) Prior Publication Data

US 2010/0313330 A1 Dec. 16, 2010

Related U.S. Application Data

(60) Provisional application No. 61/187,585, filed on Jun. 16, 2009.

(51) Int. Cl.
*A41D 13/12* (2006.01)

(52) U.S. Cl. ..... 2/114

(58) Field of Classification Search ..... 2/114, 105, 2/106, 83, 74, 104, 115, 69, 70, 48, 51, 52, 2/73, 75, 85, 108, 109, 113, 118, 121, 243.1; D2/720, 797, 798, 848
See application file for complete search history.

(56) References Cited

U.S. PATENT DOCUMENTS 646,194 A * 3/1900 Sims ..... 2/114
884,063 A * 4/1908 Baldwin ..... 2/51
1,150,006 A * 8/1915 Abrams ..... 2/74
1,620,140 A * 3/1927 Stimson ..... 2/74
D131,645 S * 3/1942 Asteroff ..... D2/797
2,319,089 A * 5/1943 Severance ..... 2/114
2,373,415 A * 4/1945 Quinn ..... 2/74
D145,334 S * 7/1946 Rost ..... D2/797
2,707,282 A * 5/1955 Paterson ..... 2/114
3,141,175 A * 7/1964 Heater et al. ..... 2/74
3,369,256 A * 2/1968 Kern ..... 2/114
3,877,078 A * 4/1975 Tepper ..... 2/74
4,296,497 A 10/1981 Herman
4,422,186 A 12/1983 Loney
4,434,511 A 3/1984 Weiser
4,524,463 A * 6/1985 Ogden ..... 2/105
4,570,268 A * 2/1986 Freeman ..... 2/114
4,578,825 A * 4/1986 Vote ..... 2/114
4,622,699 A 11/1986 Spriggs
4,653,120 A 3/1987 Leaf
4,686,715 A 8/1987 Price
4,837,863 A 6/1989 Van Scoy-Mosher
4,964,173 A 10/1990 Gordon et al.
5,001,784 A 3/1991 Orlando, Jr.
5,050,243 A 9/1991 Udell
5,062,159 A 11/1991 Jakub
5,088,117 A * 2/1992 Fulmer ..... 2/114
5,133,086 A 7/1992 Truitt et al.
5,444,872 A 8/1995 Johnson
5,878,437 A 3/1999 Pater (Continued)

*Primary Examiner* — Amy Vanatta
(74) *Attorney, Agent, or Firm* — Patterson & Sheridan, LLP

(57) ABSTRACT

A hospital gown having front and rear openings for convenient access while providing sufficient coverage of the patient's body is provided. In one embodiment, the hospital gown comprises a first segment and a second segment. When one segment is put on a patient by inserting one arm through an arm hole and the other segment is put on in the same manner but on the opposite side of the body, the front and back portions of the segments overlap at the front and back. The segments may be releasably connected to one another by fasteners located on the first and second segments at the front and back overlapping portions. The first segment then wraps around the patient's body and over a part of the second segment, and the front and back portions of the first segment are releasably connected at or near the side of the patient's body.

14 Claims, 3 Drawing Sheets

U.S. PATENT DOCUMENTS

| | | | | |
|---|---|---|---|---|
| 6,012,166 | A | 1/2000 | Burbidge | |
| 6,134,715 | A | 10/2000 | McLennan | |
| 6,499,143 | B2 | 12/2002 | Garza | |
| D547,927 | S * | 8/2007 | Booth | D2/720 |
| 7,305,716 | B1 * | 12/2007 | Richards | 2/114 |
| 2001/0044948 | A1 | 11/2001 | Tolson | |
| 2006/0277655 | A1 | 12/2006 | Kerr | |
| 2008/0000006 | A1 * | 1/2008 | Ochoa et al. | 2/114 |
| 2010/0017933 | A1 * | 1/2010 | Taylor-Barry | 2/83 |

* cited by examiner

VERSATILE HOSPITAL GOWN

CROSS-REFERENCE TO RELATED APPLICATIONS

This application claims benefit of U.S. provisional patent application Ser. No. 61/187,585, filed Jun. 16, 2009, which is herein incorporated by reference.

BACKGROUND OF THE INVENTION

1. Field of the Invention

Embodiments of the present invention generally relate to a hospital gown having front and rear openings and improved access to a patient's body while providing sufficient coverage.

2. Description of the Related Art

Standard hospital gowns or patient gowns are typically designed to provide access to a patient's body at the front or back, and generally consist of a cloth or fabric panel which wraps around the patient's body and joins at the front or back of the patient, forming a slit or opening at the front or back of the patient's body. While the design provides for improved access by physicians or attending assistants, tubing or other medical apparatus, etc., it also carries certain drawbacks. For example, the patient's privacy and dignity are oftentimes compromised as a result of poor closure at the front or back. The panel is oftentimes joined at the back (or front) by one or more string ties, which may easily become undone and/or fail to maintain the opening or slit closed along the length thereof. Accordingly, a gap tends to form along the area where the edges of the panel join or where the slit or opening is located, revealing the patient's body underneath. Oftentimes, the patient must resort to holding the edges of the panel together to close the gap. This sort of exposure may be a source of embarrassment and humiliation for a patient, especially when the patient may already be undergoing a difficult and/or traumatic experience.

Although it is desirable that a hospital gown provide sufficient coverage of the patient's body, it is also important for the gown to provide sufficient, convenient, and quick and easy access to the patient's body for purposes of medical examination, insertion of tubing or other apparatus, ease of wear, and ease of removal, among other things. It is also desirable for the hospital gown to allow convenient access at both the front and back without necessitating removal of the entire gown or of the entire top portion of the gown.

Therefore, a need exists in the art for a hospital gown that is easy to put on and take off, is comfortable to wear, provides sufficient coverage and privacy for the wearer, and still allows convenient and quick access to the patient's body.

SUMMARY OF THE INVENTION

The present invention generally relates to a gown for a medical patient. In one embodiment, the gown comprises a first segment and a second segment, wherein each segment comprises a front portion and a back portion with each front and back portion extending from the patient's shoulder to at or near the knee area, and an arm hole. The gown further comprises at least one fastener on each front and back portion of the first and second segments, wherein the fasteners are located proximate an edge near the patient's neck and at least one fastener attached to each side edge of the front and back portions of the first segment at or near the patient's waistline. The first segment wraps around the patient's body over at least a portion of the second segment, forming front and rear overlapping portions, and is releasably connected to the second segment at the overlapping portions by the fasteners located proximate the edge near the patient's neck. The front and back portions of the first segment are releasably connected at or near the side of the patient's body opposite the arm hole of the first segment by the fasteners attached to each side edge of the front and back portions of the first segment.

In another embodiment, a gown for a medical patient is provided, comprising, a first segment and a second segment. The first and second segments are disconnected and each segment comprises a front portion and a back portion with each front and back portion extending from the patient's shoulder to at or near the knee area, and an arm hole. When one segment is put on the patient by inserting one arm through the arm hole and the other segment is put on the patient in the same manner but on the opposite side of the body, the front and back portions of the first segment will overlap respectively with the front and back portions of the second segment forming front and back overlapping portions. The gown further comprises at least one fastener on each front and back portion of the first and second segments wherein the fasteners are located proximate an edge near the patient's neck; and at least one fastener attached to each side edge of the front and back portions of the first segment at or near the patient's waistline. The first segment wraps around the patient's body and over a part of the second segment, and the first segment is releasably connected to the second segment at the overlapping portions by the fasteners proximate the edge near the patient's neck. The front and back portions of the first segment are releasably connected at or near the side of the patient's body opposite the arm hole of the first segment by the fasteners attached to each side edge of the front and back portions of the first segment.

In yet another embodiment, a gown for a medical patient is provided, comprising a first segment and a second segment. Each segment comprises an arm hole, and a front portion and a back portion with each front and back portion extending from the patient's shoulder to at or near the knee area. The gown further comprises fastener means on each front and back portion of the first and second segments, wherein the fastener means are located proximate an edge near the patient's neck. The gown also comprises at least one fastener means on each side edge of the front and back portions of the first segment at or near the patient's waistline. The first segment wraps around the patient's body over at least a portion of the second segment forming front and rear overlapping portions. The first segment is releasably connected to the second segment at the overlapping portions by the fastener means located proximate the edge near the patient's neck, and the front and back portions of the first segment are releasably connected at or near the side of the patient's body opposite the arm hole of the first segment by the fastener means on each side edge of the front and back portions of the first segment.

In another embodiment, a component for a gown for a medical patient is provided, comprising a front portion and a back portion with each front and back portion extending from the patient's shoulder to at or near the knee area, and an arm hole. The component further comprises at least one fastener on each front and back portion of the component, wherein the fasteners are located proximate an edge near the patient's neck and at least one fastener attached to each side edge of the front and back portions at or near the patient's waistline. When the component wraps around the patient's body over at least a portion of a second identical component worn on the opposite side of the patient's body, the components form overlapping portions at the front and rear of the patient's body. The component is releasably connectable to the second identical component at the overlapping portions by the fasteners located proximate the edge near the patient's neck, and the front and back portions of the component are releasably connectable at or near the side of the patient's body opposite the arm hole of the component by the fasteners attached to each side edge of the front and back portions of the component.

BRIEF DESCRIPTION OF THE DRAWINGS

So that the manner in which the above recited features of the embodiments of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention provide an improved hospital gown having front and rear openings for easy and convenient access while providing sufficient coverage of the patient's body. The embodiments described herein are for exemplary purposes and are not intended to limit the scope of the claims of the present invention.

Figure 2:
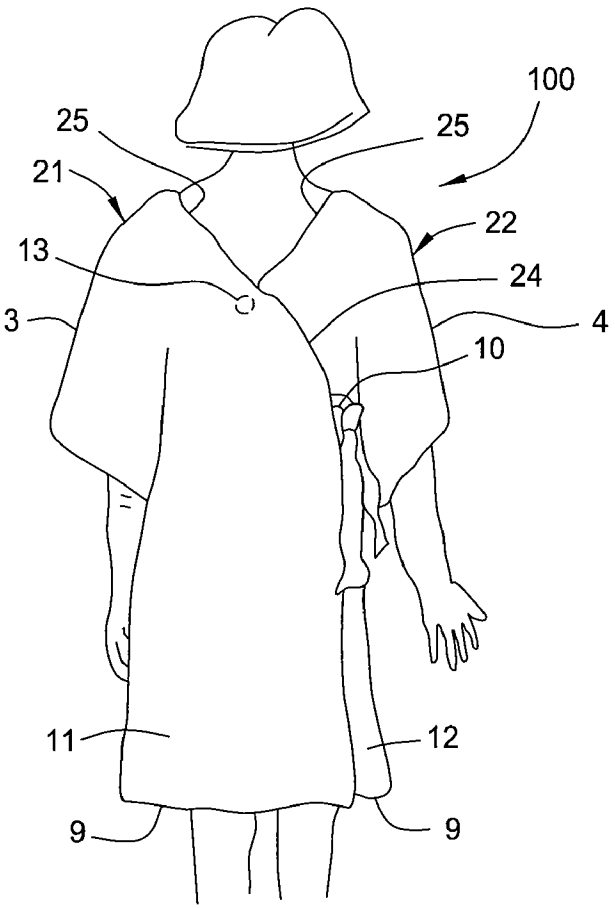
FIG. 2 is a back view of a person wearing a hospital gown in accordance with the embodiments described herein.
Figure 1:
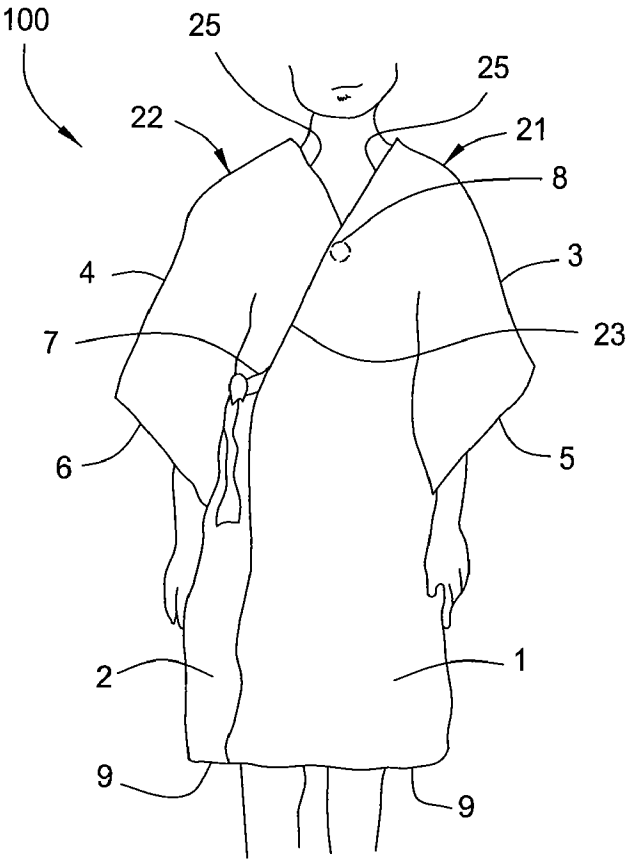
FIG. 1 is a front view of a person wearing a hospital gown in accordance with the embodiments described herein.

FIG. 1 is a front view of a person or patient wearing a hospital gown in accordance with the embodiments described herein. FIG. 2 is a back view of a person wearing a hospital gown in accordance with the embodiments described herein. Gown 100 comprises two segments, a first segment 21 and a second segment 22 (see also FIGS. 3A and 3B). The first segment 21 and second segment 22 may each comprise an armhole, formed at the upper sides of each segment which correspond to the right and left sides of the patient's body. As shown in FIGS. 1 and 2, sleeves 3 and 4 may project from first and second segments 21 and 22, respectively, defining arm holes 5 and 6, respectively. First segment 21 may comprise a front portion 1 (see FIG. 1) and a back portion 11 (see FIG. 2). Segment 22 may comprise a front portion 2 (see FIG. 1) and a back portion 12 (see FIG. 2). First segment 21 and second segment 22 may also comprise edges 25 that form a neck opening to accommodate the patient's neck when gown 100 is assembled. Edges 25 may be located near the upper portions of first segment 21 and second segment 22, as shown in FIG. 1.

Figures 3A, 3B, 4:
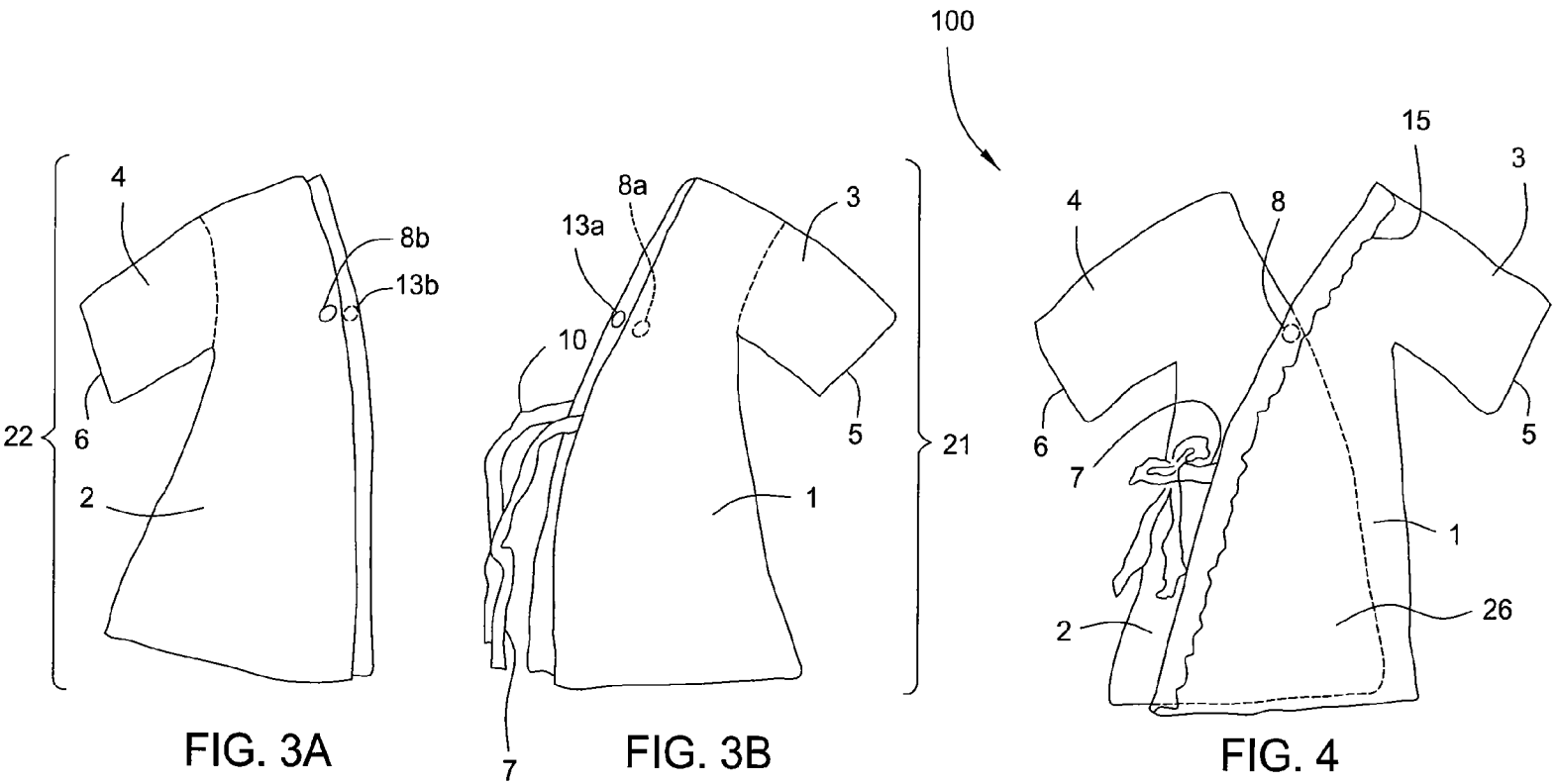
FIG. 3A is a front or back view of one segment of the hospital gown in accordance with the embodiments described herein.
FIG. 3B is a front or back view of a segment of the hospital gown corresponding to the segment shown in FIG. 3A in accordance with the embodiments described herein.
FIG. 4 is a front view of the hospital gown in accordance with one embodiment described herein, with the dotted lines showing the underlying front portion of a segment.

In one embodiment, first segment 21 and second segment 22 may each be formed from a single piece of material. For example, to form first segment 21, the material may be folded along the top edge of the shoulder portion or the top edges of the sleeve and shoulder portions so that the front portion 1 and back portion 11 of first segment 21 overlay one another. The front portion 1 and back portion 11 may be identical, such that when positioned in a face-to-face manner, the portions match up. This may also facilitate putting on the gown because the patient need not determine which of first segment 21 and second segment 22 is worn on the right side of the body and which segment is worn on the left side of the body. As shown in FIG. 3B, the front portion 1 and back portion 11 may be sewn together or attached in some other manner along the underside of the sleeve and the substantially vertical side edge of first segment 21, leaving the opposite edges of first segment 21 disconnected. Second segment 22 can also be constructed in the same manner as first segment 21.

In another embodiment, the material for each segment may be folded along a side edge so that the front and back portions of each segment, which may be identical, overlay one another. The front and back portions may be sewn together or otherwise attached along the top edge of the shoulder. If not already part of the segments, sleeves may be sewn, stitched or otherwise attached to the segments along the edges of the arm hole (see dotted lines representing seams in FIGS. 3A and 3B).

In yet another embodiment, the front and back portions of a segment may be separate pieces of material, wherein the front and back portions, which may be identical, may overlay one another and may be joined to form the segment by sewing, stitching or otherwise attaching the portions along the top edge of the shoulder and the edge located on the side of the arm hole. In some embodiments, the sleeve can form a part of each front portion and back portion piece of material.

In other embodiments, the sleeve may be attached after the segment is formed from the front portion and the back portion. In some embodiments, each segment may be formed from two, three, four, or more panels or pieces of material. Construction of the segment is not limited to the embodiments described above.

The sleeve itself may, in one embodiment, be formed from one piece of material folded onto itself and sewn, stitched or otherwise connected along an edge opposite the fold. In another embodiment, the sleeve may be formed from two or more pieces of material which may be sewn, stitched or otherwise connected along edges thereof. The two or more pieces of material may or may not be identical. It should be noted that each segment or sleeve of a segment may be formed from one, two, three, or more pieces of material. Construction of the sleeve is not limited to the embodiments described above.

The width of each of first segment 21 and second segment 22 at the area at or near the waist of the patient to the bottom edge of the segment may be substantially the same as the width of the patient's body. In another embodiment, the width of each of first segment 21 and second segment 22 may be smaller than the width of the patient's body, thereby resulting in less overlap between first segment 21 and second segment 22 when the patient is wearing the gown 100. However, the width of each segment should be large enough to result in sufficient overlap between the front portion of the first segment 21 and the front portion of the second segment 22, and the back portion of the first segment 21 and the back portion of the second segment 22, thus providing enough coverage in the front and back of the patient's body.

As shown in FIGS. 1 and 2, gown 100 may have a length extending from the patient's shoulders to at or near the patient's knees. However, this length may vary depending on the application of the hospital gown, the height of the patient, or the circumstances under which the gown will be used. In some circumstances, gown 100 may be longer because the patient may desire greater leg coverage for reasons of modesty or comfort. In other circumstances, the patient may desire less leg coverage in order to provide better access to a portion of the leg, such as the knee, if desired.

Each segment is placed on an opposite side of the body of the patient. In the embodiment shown in FIGS. 1 and 2, sleeve 3 receives the patient's left arm, and sleeve 4 receives the patient's right arm. As shown in FIGS. 1 and 2, when first segment 21 is put on the patient by inserting the left arm through arm hole 5 and second segment 22 is put on the patient by inserting the right arm through arm hole 6, the front and back portions of first segment 21 will overlap respectively with the front and back portions of second segment 22, forming front and back overlapping portions (see representation of a front overlapping portion 26 in FIG. 4). In this manner, the two segments will enclose the patient's body. In one embodiment, these overlapping portions may be similar to the overlap formed in the front of a traditional bath robe, as shown in FIGS. 1 and 2. These front and back overlapping portions may each extend vertically down the patient's body from an area located in between the patient's neckline and the patient's chest to the bottom edge of gown 100. The overlapping front and back portions may horizontally extend across about a sixth, or a fifth, or a fourth, or a third, or a half, or as much as the entire width of the patient's body. However, the front and back overlapping portions should not be limited to these proportions. It should be understood that the front and back overlapping portions should be large enough to prevent gaps or openings from forming at the front and back of gown 100 where first segment 21 and second segment 22 come together in order to prevent exposure of the patient's body. These front and back overlapping portions should be appropriately sized and placed on the patient's body so as to prevent gaps or openings from forming at the front and back sections of gown 100 where first segment 21 and second segment 22 come together. It should also be noted that the front and back overlapping portions may be different in size, depending on the patient's body and how each segment fits the patient's body.

First segment 21 and second segment 22 may each comprise at least one fastener on each front and back portion. The fasteners may be located near the loose edge of each first and second segment between the patient's neckline and the patient's chest, or proximate the patient's neck and at or above the patient's chest, so that the fastener may be located at upper sections of the front and back overlapping portions. The fasteners may releasably connect the first and second segments at the upper sections of the front and back overlapping portions. For example, as shown in FIG. 1, fastener 8 may be located proximate to where first segment 21 overlaps second segment 22 at the upper section of front overlapping portion 26 (see FIG. 4) and proximate the edges of first segment 21 and second segment 22. Once the patient has placed the first segment 21 and the second segment 22 on the left and right sides of the body, respectively, the patient may then releasably connect first segment 21 and second segment 22 at the front using fastener 8 and at the back using fastener 13 (see FIG. 2).

Fasteners 8 and 13 may comprise Velcro® (or Velcro type fastener), hook, snap, button, tie, loop and eye fasteners, nylon snaps, or a zipper. Further, fasteners 8 and 13 may each comprise two fastener portions, one fastener portion located on the front portion of one segment and the other fastener portion located on the front portion of the other segment. For example, fastener 8 may comprise a snap button component 8*a* on the inside surface of the front portion 1 of first segment 21 and a mating or corresponding snap button component 8*b* on the outside surface of the front portion 2 of second segment 22. Snap button components 8*a* and 8*b* may releasably couple when snapped together, releasably connecting front portions 1 and 2 of first and second segments 21 and 22, respectively. Similarly, fastener 13 may comprise a snap button component 13*a* on the inside surface of the back portion 11 of first segment 21 and a corresponding snap button component 13*b* on the outside surface of the back portion 12 of second segment 22. Each snap button component may be sewn, glued, or otherwise attached to the material of gown 100. In some embodiments, fastener 8 may be different from fastener 13. For example, fastener 8 may comprise a tie, and fastener 13 may comprise a snap button, or fastener 8 may comprise Velcro® and fastener 13 may comprise a hook. Also, there may be more than one fastener at the front of gown 100 or at the back of gown 100. In other embodiments, fastener 8 and fastener 13 may each comprise more than one fastening mechanism.

It should be noted, however, that there should be at least one fastener both on the front and back of gown 100 located at an area between the patient's neckline and the patient's chest to keep first segment 21 and second segment 22 connected and overlapping at the front and back of gown 100 in order to provide sufficient coverage at the chest and back areas. Also, it is desirable that fasteners 8 and 13 release easily allowing for quick access to the patient's front and back, but fasten firmly enough to keep first segment 21 and second segment 22 connected together at the upper front and back of gown 100. Furthermore, it may be desirable for fasteners 8 and 13 to be easily fastened and unfastened by the patient, who may sometimes have difficulty handling small objects or accessing certain hard-to-reach areas of the body, such as the back. Fasteners which are easy to fasten and unfasten may also help medical personnel conveniently and quickly open gown 100 to gain access to the patient's body.

As shown at FIG. 3B, the first segment 21 may comprise a fastening mechanism, such as a tie, or strap 7, at the loose side edge of front portion 1 of first segment 21, and another fastening mechanism, such as a tie, or strap 10, at the loose side edge of back portion 11 of first segment 21 (see also FIG. 2). As shown in FIGS. 1 and 2, these fastening mechanisms releasably connect the front portion 1 and back portion 11 of first segment 21 at a location proximate the patient's waist and at or near the side of the patient's body opposite the arm hole of first segment 21 when first segment 21 is wrapped around the patient's body. In one embodiment, first segment 21 may contain more than one fastening mechanism at the loose side edges of the front portion 1 and back portion 11. The fastening mechanism releasably connecting the front portion 1 and back portion 11 may comprise Velcro®, hook, snap, button, tie, loop and eye fasteners, nylon snaps, or a zipper.

In the embodiment comprising more than one fastening mechanism coupled with the loose side edges of the front portion 1 and back portion 11 each of the fastening mechanisms may be of different types, so long as each fastening mechanism coupled with front portion 1 of first segment 21 has a corresponding fastening mechanism coupled with back portion 11 of first segment 21 which can connect to the fastening mechanism on the front portion 1 so as to join the front portion 1 and back portion 11 of first segment 21. Gown 100 may incorporate different types of fasteners and fastening mechanisms. For example, fasteners 8 and 13 may be of the same or of a different type than straps 7 and 10. In one embodiment, straps 7 and 10 may be long enough so that they may be tied or joined even if the front portion 1 and back portion 11 are not capable of extending across the full width of the patient's body. These longer straps can also allow patients of different sizes and weights to wear gown 100 by allowing adjustment along the waist. Furthermore, this feature may reduce the number of different sizes of gown 100 that may need to be made available to the public, and may even allow gown 100 to be made available in "one size fits all".

In one embodiment, first segment 21 and second segment 22 may be symmetrical, mirror images of each other, so that the patient, the hospital staff, or the patient's caregiver need not be concerned with determining which segment should be worn on the right side of the body and which segment should be worn on the left side of the body. This embodiment would also dispense with having to keep track of the segments to ensure that the segments are matched up correctly, such as when the segments are laundered. In such an embodiment, first segment 21 and second segment 22 may both comprise fastening mechanisms (not shown), such as straps 7 and 10, so that either first segment 21 or second segment 22 is able to wrap over the other segment. In this embodiment, the patient or person putting on gown 100 may connect the front and back portions of each segment at each side of the body using the fastening mechanisms or the patient may only fasten the fastening mechanisms of one segment. For example, the fastening mechanisms of second segment 22 may be left unfastened at one side of the body and only the fastening mechanism of first segment 21 may be fastened when first segment 21 wraps over second segment 22. In either of these foregoing embodiments, fasteners 8 and 13 may be fastened at the upper sections of the overlapping portions in order to keep first segment 21 and second segment 22 joined at or near the neck or chest area.

The fastening mechanisms on one or both segments proximate the patient's waist (such as straps 7 and 10 on first segment 21) may also help keep gown 100 on the patient's body and provide coverage to the patient's body from about the waist down in the event that one or both fasteners 8 and 13 are unfastened, such as when the patient's chest and/or back is being examined (e.g., during a breast examination). Similarly, fasteners 8 and 13 may help keep the gown 100 on the patient's upper body in the event, that the straps 7 and 10 are unfastened, such as when a portion of the patient's lower body is being examined.

As shown in FIGS. 1 and 2, edges 25 may form a V-shaped neckline at the front and back of gown 100 when first segment 21 and second segment 22 come together. In another embodiment, neck openings may form a rounded neckline at the front and back of gown 100 when first segment 21 and second segment 22 come together. It should be noted that the neckline is not limited to a V-shape or rounded shape, and may be a boat neck or square type of neckline. In yet another embodiment, the neckline may lie closer to the patient's neck in order to provide greater coverage near the neck and chest area. In another embodiment, the shape and location of the neckline formed at the front of the gown may be different from the neckline formed at the back of the gown. For example, the neckline at the front of the gown may form a V-shape, and the neckline at the back of the gown may be circular and may be located higher on the patient's back.

In one embodiment, sleeve 3 receives the patient's left arm, and sleeve 4 receives the patient's right arm. Sleeves 3 and 4 may extend past the patient's elbows in order to provide more coverage of the patient's arms or keep the patient warm. Sleeves 3 and 4 may be shorter in length so as to expose a greater part of the patient's arms. It is desirable that sleeves 3 and 4 be wide enough to accommodate tubing or other medical apparatus that may need to be connected to a patient's body. In another embodiment, the sleeves may be adjustable in length, such as by rolling the sleeves up and providing a fastener to maintain the sleeve in a rolled-up position. In another embodiment, the sleeves may have means for adjusting the fit around the patient's arm. For example, the sleeve may comprise a drawstring at the edge thereof which may be pulled if the patient wishes to have a more snug fit, or which may be loosened to provide access to the patient's arm.

In one embodiment, gown 100 may comprise a double layer of material or fabric so that the inside surfaces of gown 100 may be of a different material or fabric than the outside surface. For example, the inside surface of gown 100 may comprise a soft material such as flannel or satin or silk, while the outside surface of gown 100 may comprise a more stain-resistant or aesthetically pleasing material or fabric.

Figure 5:
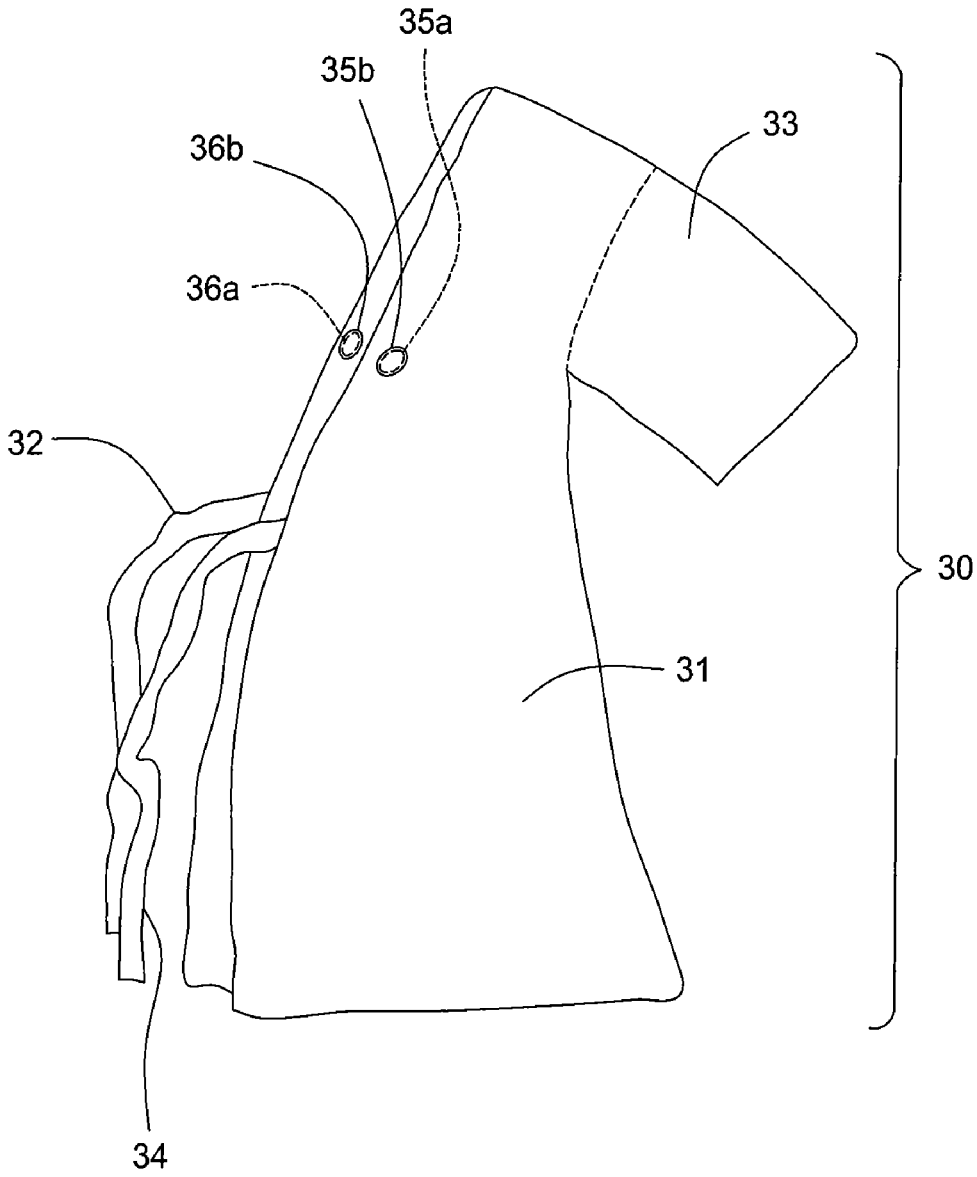
FIG. 5 is a front view of a component for a hospital gown in accordance with one embodiment described herein.

In yet another embodiment, a component 30 for a gown for a medical patient may be provided, as shown in FIG. 5. The component 30 may comprise a front portion 31 and a back portion (not shown) with each front and back portion extending from the patient's shoulder to at or near the knee area, a neck opening, and an arm hole, similar to first segment 21 described above. Component 30 may also comprise sleeve 33. Component 30 may be sewn or put together in a manner similar to first segment 21. Component 30 may comprise at least one fastener located proximate the patient's neck on each front and back portion.

The fastener may be of a type that permits component 30 to be worn on the right side or the left side of the patient's body. For example, as shown in FIG. 5, component 30 may comprise a female snap **35*b* on the outside face of the front portion near the neck or chest area and a female snap 36*a* on the outside face of the back portion near the neck or upper back area, and a male snap 35*a* on the inside face of the front portion near the neck or chest area and a male snap 36*b* on the inside face of the back portion near the neck or upper back area. Male snap 35*a* may be located near the same area of front portion 31, but on the inside face of component 30, as female snap 35*b*, so that male snap 35*a* would mirror female snap 35*b*. Similarly, female snap 36*a* may be located near the same area, but on the outside face of component 30, as male snap 36*b*, so that female snap 36*a* would mirror male snap 36*b*. Snaps 35*a*, 35*b*, 36*a* and 36*b* are disposed at locations on component 30 which would match up with mating or corresponding snaps on another component identical to component 30. Similarly, Velcro or a Velcro type fastener, hook and eye, button or other types of fasteners may be used instead of snaps and placed in the same manner as described above. Instead of using male/female snaps, ties may be used, in which case it would be unnecessary to have a tie on both inside and outside faces of the front and back segments by placing the ties on the side edges of each segment (similar to straps 7 and 10** described above).

Component 30 may also comprise at least one fastener attached to each side edge of the front and back portions at or near the patient's waistline. For example, component 30 may comprise tie 34 on front portion 31 and tie 32 on the back portion. Component 30 may wrap around the patient's body over at least a portion of a second identical component worn on the opposite side of the patient's body, such that front and rear overlapping portions are formed by both components. Component 30 may be releasably connected to the second identical component at the overlapping portions by the fasteners (such as snaps **35*a*, 35*b*, 36*a* and 36*b*) located proximate the patient's neck. The front and back portions of component 30 may be releasably connected at or near the side of the patient's body opposite the arm hole of component 30 by the fasteners attached to each side edge of the front and back portions of the component, such as ties 32 and 34**.

In one embodiment, component 30 may be reversible so that two identical components 30 can be connected together using the snaps described above (shown in FIG. 5), or another type of fastener. In another embodiment, component 30 may be worn on the left side of the patient's body, with the front portion 31 on the back of the patient and the back portion on the front of the patient. The reversibility of component 30 may facilitate wear by a patient without concern for determining which surface of the gown is worn inside against the body, and which surface of the gown is worn on the outside, or which segment goes on which side of the body. This feature may also result in increased wear, functionality, and add variety to the patient's wardrobe by allowing different materials to be used on the inside and outside faces of the component. Therefore, the patient would be able to mix and match materials, and, if one face were to become stained, the patient could merely turn the segment inside-out and continue to wear the segment, thus extending the gown's serviceable life. Further, it would be unnecessary to keep track of matching halves, such as in the laundry, because any component could be connected to another component.

In yet another embodiment, first segment 21 and second segment 22 may be reversible. In this embodiment, first segment 21 and second segment 22 may comprise fasteners and fastening mechanisms on both the inside and outside faces such that first segment 21 and second segment 22 may be fastened or connected in the same manner as explained above, regardless of whether one or both segments are reversed. In another embodiment, first segment 21 and second segment 22 may also be exchanged and worn with the front portion of each segment on the back and the back portion of each segment on the front. In that embodiment, the segment that was worn on the right side of the body is now worn on the left side of the body and the segment that was worn on the left side of the body is now worn on the right side of the body.

In another embodiment, first segment 21 and second segment 22 may each comprise means for coupling the segments to one another when the segments are not being worn to keep the segments together. The means for coupling may include ties, straps, buttons, or snaps. The coupling means may comprise fasteners 8 and 13. The coupling means may also comprise fastening mechanisms proximate the waist. When first segment 21 and second segment 22 are washed or otherwise handled, the segments connected via the coupling means will remain together. This allows the patient or person handling the gown to keep track of corresponding first segment 21 and second segment 22 of gown 100.

In addition to providing convenient access to a patient's body while maintaining sufficient coverage, the gown 100 may be manufactured to be aesthetically pleasing to the patient or wearer. For example, the gown 100 described in the foregoing embodiments may be manufactured from a variety of materials. First segment 21 and second segment 22 may be manufactured from different types of fabric, such as cotton, silk, satin, rayon, velvet, fleece, etc. The fabric may be chosen so as to provide warmth and comfort to the patient. In other circumstances, a fabric that keeps a patient cool may also be used. In another embodiment, a stain-resistant fabric may be used. Washable silk may also be used to manufacture gown 100. The material used for gown 100 may also be a disposable fiber material. The material may have a pattern or print, such as a designer print. Materials in bright colors, or more subdued colors or shades may also be used. The material may be shimmery, such as satin, or may have different textures. Complementary prints or colors may be used for each segment of gown 100. For example, first segment 21 may be manufactured from a solid blue material and segment 22 may be manufactured from a blue patterned material. Different materials may be used for different parts of each segment, such as the sleeves or the ties, if any.

Gown 100 may also comprise accessories or detailing to improve the gown's aesthetic appearance and lift the patient's spirits or make a patient's hospital stay more pleasant. For example, as shown in FIG. 4, gown 100 may comprise a ruffle 15 along the length of the loose edge of front and/or back portions of first segment 21. A similar ruffle may be provided on second segment 22 (not shown). In one embodiment, a ruffle may be provided along a bottom hem 9 of each of first segment 21 and second segment 22. Ruffles or other types of trim may be attached to the sleeves 3 and 4 at arm holes 5 and 6 (see FIG. 1, ruffles not shown), or along the hem of edges 23 and 24 (see FIGS. 1 and 2), or along other portions of gown 100. In another embodiment, gown 100 may comprise one or more pockets, such as for placing eyeglasses, pens, or other objects therein. The pockets may be located at different areas of gown 100, such as at the front of the gown near the hip, thigh or chest area. Pockets may also be located on the back of gown 100, or on the inside face of gown 100.

Gown 100 may comprise additional decorative features, such as rhinestones, accents in different types of fabric, thread, or trim, bows, monograms, and personalized stitching. These decorative features are merely examples and are not intended to limit the features which may be added to gown 100 to make it more aesthetically pleasing.

While the foregoing is directed to embodiments of the present invention, other and further embodiments of the invention may be devised without departing from the basic scope thereof, and the scope thereof is determined by the claims that follow.

The invention claimed is:

1. A gown for a medical patient comprising:

a first segment and a second segment, wherein each first and second segment comprises:

a front portion and a back portion with each front and back portion extending from a patient's shoulder to at or near a knee area;

an arm hole;

at least one fastener on each front and back portion of the first and second segments, wherein the fasteners are located proximate an edge near a patient's neck; and at least one fastener attached to each side edge of the front and back portions of the first segment at or near a patient's waistline, wherein the first segment wraps around a first side of a patient's body and the second segment wraps around a second side of the patient's body, the first segment covering at least a portion of the front and back portions of the second segment and forming front and rear overlapping portions, wherein the first segment releasably fastens to the second segment at the overlapping portions by the fasteners located proximate the edge near the patient's neck, and wherein the front and back portions of the first segment releasably connect at or near the second side of the patient's body at or near the patient's waistline by the fasteners attached to each side edge of the front and back portions of the first segment.

2. The gown of claim 1, wherein the fasteners located proximate the edge near the patient's neck are selected from the group consisting of hook and loop fasteners, hook, snap, button, tie, loop and eye fasteners, nylon snaps, and zipper.

3. The gown of claim 1, wherein the fasteners attached to each side edge of the front and back portions of the first segment comprise straps.

4. The gown of claim 1, wherein the gown is tapered at the waist to conform to the patient's body.

5. The gown of claim 1, further comprising at least one fastener attached to each side edge of the front and back portions of the second segment at or near the patient's waistline.

6. The gown of claim 1, wherein the gown comprises a textile fabric.

7. The gown of claim 1, wherein the first and second segments form a V-shape neck opening when the first and second segments are worn together.

8. The gown of claim 1, wherein the first segment and the second segment are reversible.

9. A gown for a medical patient comprising:

a first segment and a second segment, wherein the first and second segments are disconnected and wherein each segment comprises:

a front portion and a back portion with each front and back portion extending from a patient's shoulder to at or near a knee area; and an arm hole, whereby the first segment is put on the patient by inserting one arm through the arm hole of the first segment and the second segment is put on the patient by inserting a second arm through the arm hole of the second segment;

at least one fastener on each front and back portion of the first and second segments wherein the fasteners are located proximate an edge near a patient's neck; and a single strap attached to each side edge of the front and back portions of the first segment at or near a patient's waistline, wherein the first segment wraps around a patient's body and over a portion of the second segment such that the front and back portions of the first segment overlap, respectively, with the front and back portions of the second segment, forming front and back overlapping portions, wherein the first segment releasably fastens to the second segment at the overlapping portions by the fasteners located proximate the edge near the patient's neck, and wherein the front and back portions of the first segment releasably connect at or near the side of the patient's body opposite the arm hole of the first segment by the straps, the straps wholly located external to the gown when assembled.

10. The gown of claim 9, wherein the fasteners located proximate the edge near the patient's neck are selected from the group consisting of hook and loop fasteners, hook, snap, button, tie, loop and eye fasteners, nylon snaps, and zipper.

11. The gown of claim 9, further comprising a fastener attached to each side edge of the front and back portions of the second segment at or near the patient's waistline.

12. A gown for a medical patient comprising:

a first segment and a second segment, wherein each segment comprises:

a front portion and a back portion with each front and back portion extending from a patient's shoulder to at or near a knee area;

a neck opening; and an arm hole;

a single fastener on each front and back portion of the first and second segments located proximate an edge near a patient's neck; and a single strap on each side edge of the front and back portions of the first segment at or near a patient's waistline, wherein the first segment wraps around a patient's body over at least a portion of the second segment forming front and rear overlapping portions, and wherein the first segment is releasably fastened to the second segment at the overlapping portions by the fastener located proximate the edge near the patient's neck, and wherein the front and back portions of the first segment are releasably connected at or near the side of the patient's body opposite the arm hole of the first segment by the straps, the straps wholly located external to the gown when assembled.

13. The gown of claim 12, further comprising a fastener means on each side edge of the front and back portions of the second segment at or near the patient's waistline.

14. A component for a gown for a medical patient comprising:

a front portion and a back portion with each front and back portion extending from a patient's shoulder to at or near a knee area;

an arm hole;

a single fastener on each front and back portion of the component located proximate an edge near a patient's neck; and a single strap attached to each side edge of the front and back portions at or near a patient's waistline, wherein the component wraps around a patient's body over at least a portion of a second identical component worn on a opposite side of the patient's body, forming overlapping portions at a front and rear of the patient's body, and wherein the component is releasably connectable to the second identical component at the overlapping portions by the fasteners located proximate the edge near the patient's neck, and wherein the front and back portions of the component are releasably connectable at or near a side of the patient's body opposite the arm hole of the component by the strap attached to each side edge of the front and back portions of the component.

* * * * *